US006755736B2

(12) United States Patent
Yang

(10) Patent No.: US 6,755,736 B2
(45) Date of Patent: Jun. 29, 2004

(54) COMPUTER-IMPLEMENTED METHOD AND GAMING APPARATUS FOR PLAYING TWO DIFFERENT CARD GAMES SIMULTANEOUSLY

(75) Inventor: Arden Yang, Rosemead, CA (US)

(73) Assignee: Tai Game Tech Corp., Taipei Hsien (TW)

( * ) Notice: Subject to any disclaimer, the term of this patent is extended or adjusted under 35 U.S.C. 154(b) by 291 days.

(21) Appl. No.: 10/113,243

(22) Filed: Apr. 1, 2002

(65) Prior Publication Data

US 2003/0130022 A1 Jul. 10, 2003

(30) Foreign Application Priority Data

Jan. 10, 2002 (TW) ..... 9110237 A

(51) Int. Cl.[7] ..... A63F 9/24
(52) U.S. Cl. ..... 463/13; 273/292
(58) Field of Search ..... 463/11, 12, 13; 273/292, 303, 309, 237, 274

(56) References Cited

U.S. PATENT DOCUMENTS 4,836,553 A * 6/1989 Suttle et al. ..... 273/292
4,856,787 A * 8/1989 Itkis ..... 273/237
5,294,128 A * 3/1994 Marquez ..... 273/292
5,328,189 A * 7/1994 Malek ..... 273/292
5,356,140 A * 10/1994 Dabrowski et al. ..... 463/12
5,382,025 A * 1/1995 Sklansky et al. ..... 273/292
5,395,120 A * 3/1995 Malek ..... 273/292
5,794,934 A * 8/1998 Malcolm ..... 273/292
5,823,873 A * 10/1998 Moody ..... 463/13
6,132,311 A * 10/2000 Williams ..... 463/13
6,474,645 B2 * 11/2002 Tarantino ..... 273/274
6,511,068 B1 * 1/2003 Sklansky et al. ..... 273/237
2002/0103018 A1 * 8/2002 Rommerdahl et al. ..... 463/16

* cited by examiner

*Primary Examiner*—Michael O'Neill
(74) *Attorney, Agent, or Firm*—Ladas & Parry

(57) ABSTRACT

In a computer-implemented method and gaming apparatus, a randomly selected card is matched with dealt playing cards for playing a first card game, and is combined with the dealt playing cards for poker hand ranking evaluation for playing a second card game simultaneously. A computer program product for a gaming apparatus that includes a user input unit, a display unit and a processor unit is also disclosed.

12 Claims, 4 Drawing Sheets

COMPUTER-IMPLEMENTED METHOD AND GAMING APPARATUS FOR PLAYING TWO DIFFERENT CARD GAMES SIMULTANEOUSLY

CROSS-REFERENCE TO RELATED APPLICATION

This application claims priority of R.O.C. patent application Ser. No. 091100237, filed on Jan. 10, 2002.

BACKGROUND OF THE INVENTION

1. Field of the Invention

The invention relates to a gaming apparatus, more particularly to a computer-implemented method and gaming apparatus for playing two different card games simultaneously.

2. Description of the Related Art

Conventional gaming apparatus allow players to play only one kind of card game at one time. After playing for a period of time, the player will get bored easily.

SUMMARY OF THE INVENTION

Therefore, the object of the present invention is to provide a computer-implemented method and gaming apparatus for playing two different card games simultaneously so that the player does not get bored easily.

According to one aspect of the invention, there is provided a computer-implemented method for playing first and second card games simultaneously. The computer-implemented method comprises:

(a) providing a gaming apparatus that includes a user input unit and a display unit;

(b) dealing a player a set of playing cards from a deck of simulated playing cards, and showing the set of the playing cards face down on the display unit;

(c) allowing the player to place a first bet for at least one of the playing cards and to place a second bet for the set of the playing cards via the user input unit; and (d) playing the first and second card games simultaneously, including the steps of showing the set of the playing cards face up on the display unit, randomly selecting another one of the playing cards from the non-dealt simulated playing cards in the deck, determining winnings of the player in the first card game by matching each of the playing cards placed with the first bet with the randomly selected one of the playing cards, combining the randomly selected one of the playing cards with the set of the playing cards dealt to the player to obtain a card hand, determining winnings of the player in the second card game by evaluating a value for the card hand in accordance with a predetermined poker hand ranking, and adjusting a credit total for the player according to the winnings of the player in the first and second card game.

According to another aspect of the invention, there is provided a computer program product for a gaming apparatus that includes a user input unit, a display unit and a processor unit coupled to the user input unit and the display unit. The computer program product adapts the gaming apparatus for playing first and second card games simultaneously, and comprises:

a computer readable storage medium comprising:

a first code that directs the processor unit to deal a player a set of playing cards from a deck of simulated playing cards, and to show the set of the playing cards face down on the display unit;

a second code that directs the processor unit to allow the player to place a first bet for at least one of the playing cards and to place a second bet for the set of the playing cards via the user input unit; and a third code that directs the processor unit to play the first and second card games simultaneously, including a code that directs the processor unit to show the set of the playing cards face up on the display unit, a code that directs the processor unit to randomly select another one of the playing cards from the non-dealt simulated playing cards in the deck, a code that directs the processor unit to determine winnings of the player in the first card game by matching each of the playing cards placed with the first bet with the randomly selected one of the playing cards, a code that directs the processor unit to combine the randomly selected one of the playing cards with the set of the playing cards dealt to the player to obtain a card hand, a code that directs the processor unit to determine winnings of the player in the second card game by evaluating a value for the card hand in accordance with a predetermined poker hand ranking, and a code that directs the processor unit to adjust a credit total for the player according to the winnings of the player in the first and second card games.

According to yet another aspect of the invention, a gaming apparatus is adapted for playing first and second card games simultaneously, and comprises:

a user input unit;

a display unit;

means for dealing a player a set of playing cards from a deck of simulated playing cards, and for showing the set of the playing cards face down on the display unit;

means for allowing the player to place a first bet for at least one of the playing cards and to place a second bet for the set of the playing cards via the user input unit; and means for playing the first and second card games simultaneously, including means for showing the set of the playing cards face up on the display unit, means for randomly selecting another one of the playing cards from the non-dealt simulated playing cards in the deck, means for determining winnings of the player in the first card game by matching each of the playing cards placed with the first bet with the randomly selected one of the playing cards, means for combining the randomly selected one of the playing cards with the set of the playing cards dealt to the player to obtain a card hand, means for determining winnings of the player in the second card game by evaluating a value for the card hand in accordance with a predetermined poker hand ranking, and means for adjusting a credit total for the player according to the winnings of the player in the first and second card games.

According to a further aspect of the invention, a gaming apparatus comprises a user input unit, a display unit, a processor unit coupled to the user input unit and the display unit, and a computer program product for adapting the gaming apparatus for playing first and second card games simultaneously. The computer program product comprises a computer readable storage medium that includes:

a first code that directs the processor unit to deal a player a set of playing cards from a deck of simulated playing cards, and to show the set of the playing cards face down on the display unit;

a second code that directs the processor unit to allow the player to place a first bet for at least one of the playing cards and to place a second bet for the set of the playing cards via the user input unit; and a third code that directs the processor unit to play the first and second card games simultaneously, including a code that directs the processor unit to show the set of the playing cards face up on the display unit, a code that directs the processor unit to randomly select another one of the playing cards from the non-dealt simulated playing cards in the deck, a code that directs the processor unit to determine winnings of the player in the first card game by matching each of the playing cards placed with the first bet with the randomly selected one of the playing cards, a code that directs the processor unit to combine the randomly selected one of the playing cards with the set of the playing cards dealt to the player to obtain a card hand, a code that directs the processor unit to determine winnings of the player in the second card game by evaluating a value for the card hand in accordance with a predetermined poker hand ranking, and a code that directs the processor unit to adjust a credit total for the player according to the winnings of the player in the first and second card games.

Because two different card games are played simultaneously in a single game round, the player's desire for variety can be satisfied, and player interest can be prolonged.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
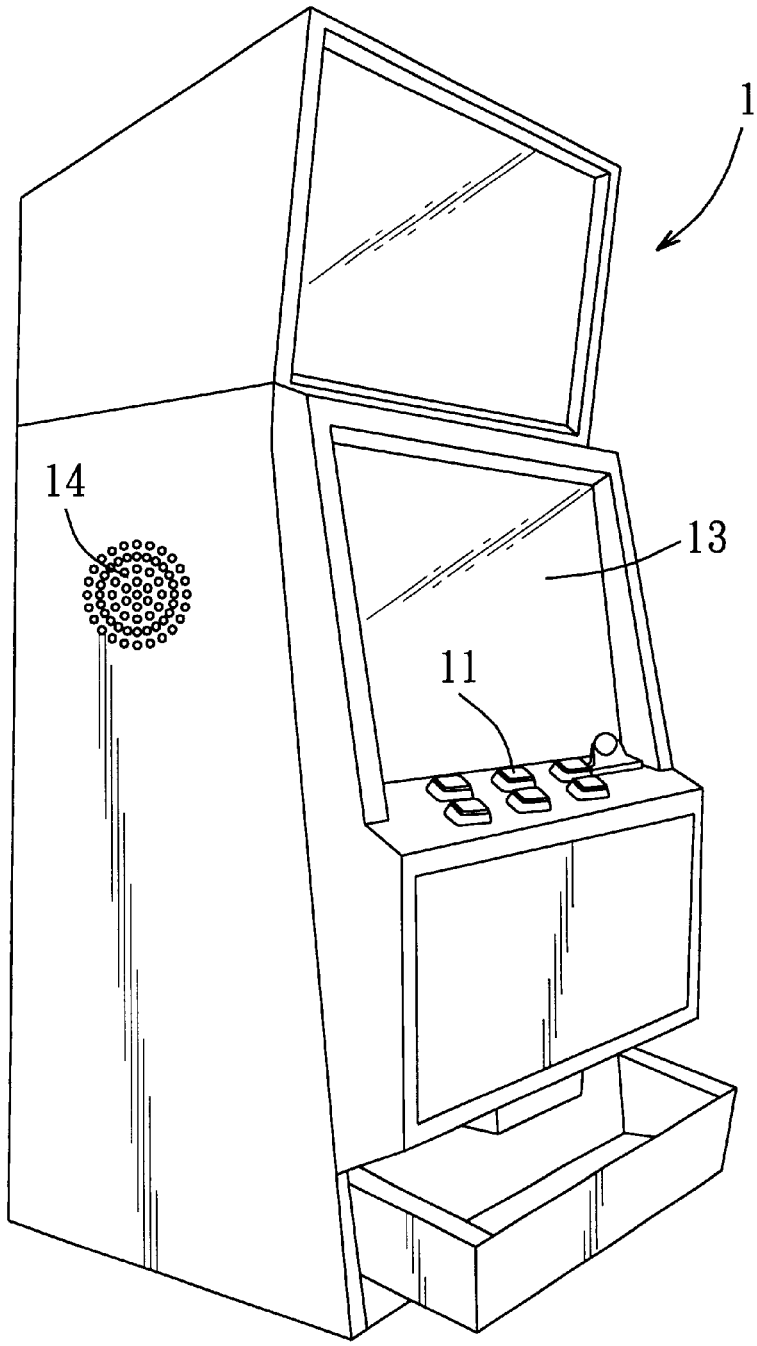
FIG. 1 is a perspective view of the preferred embodiment of a gaming apparatus according to the present invention.
Figure 2:
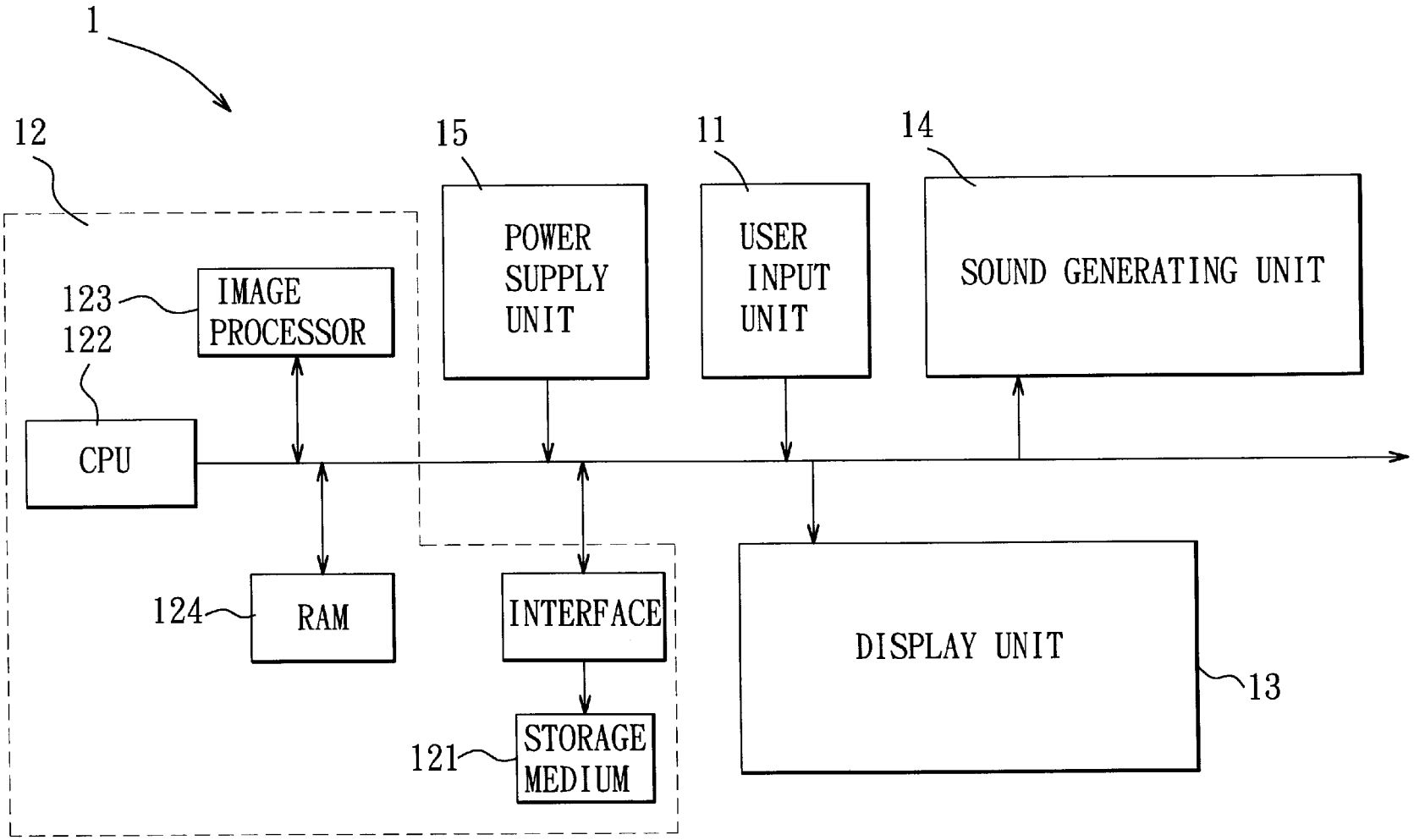
FIG. 2 is a schematic circuit block diagram of the preferred embodiment.

Referring to FIG. 1, the preferred embodiment of a gaming apparatus 1 according to the present invention is adapted for playing two different card games simultaneously. Referring further to FIG. 2, the gaming apparatus 1 comprises a user input unit 11, a processor unit 12, a display unit 13, a sound generating unit 14, and a power supply unit 15 coupled to the user input unit 11, the processor unit 12, the display unit 13 and the sound generating unit 14. The user input unit 11 is operable so as to receive an input from the user. The display unit 13 is operable so as to show game images thereon. The sound generating unit 14 is operable so as to provide audible instructions and information to the user. The processor unit 12 is coupled to and controls the operations of the user input unit 11, the display unit 13 and the sound generating unit 14 in accordance with preprogrammed instructions. Preferably, the processor unit 12 is in the form of a circuit board that is mounted removably in the gaming apparatus 1 and that includes: a computer readable storage medium 121, such as a read-only memory device, recorded with program codes for performing the computer-implemented method of this invention; a central processing unit (CPU) 122 for executing the program codes; an image processor 123; and a random access memory (RAM) 124. However, it should be apparent to those skilled in the art that the processor unit 12 can also be implemented with a storage medium in the form of a floppy disk, a compact disk, a game cartridge, etc.

Figure 3:
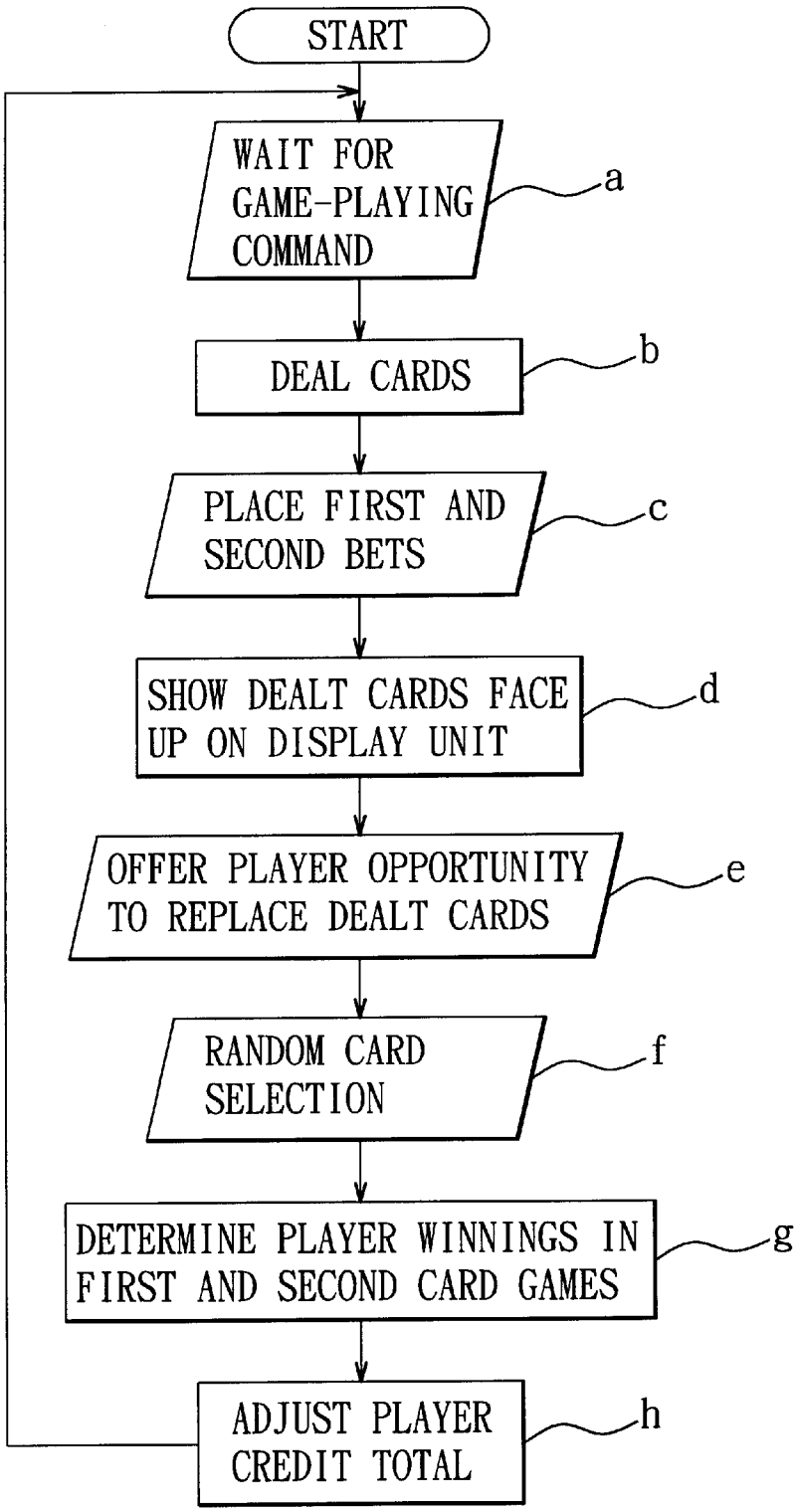
FIG. 3 is a flowchart to illustrate the preferred embodiment of a computer-implemented method for playing two different card games simultaneously according to the present invention.

Referring to FIG. 3, the program codes in the storage medium 121 control game progress as follows:

Step (a): First, game-initiating processing is executed. When the gaming apparatus 1 is activated, the CPU 122 retrieves image data from the storage medium 121 and sends the same to the image processor 123 for processing. The output of the image processor 123 is sent to the display unit 13 to serve as a visual interface with the player. At the same time, audio data will be sent to the sound generating unit 14 for audio effects. As such, prior to starting a game, the display unit 13 is able to show a series of demonstration images until the player enters a game-playing command via the user input unit 11. The game-playing command can be input as a result of a coin-inserting action, and the flow proceeds to the next step (Step (b)) in response to the game-playing command.

Figure 4:
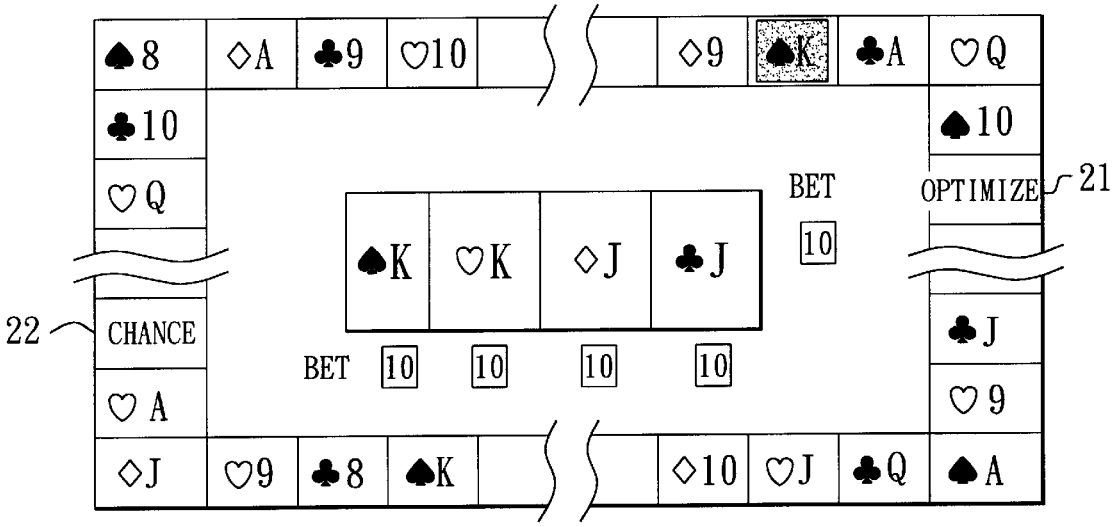
FIG. 4 is a schematic view to illustrate how progress of first and second card games is shown on a display unit according to this invention.

Step (b): Upon receipt of the game-playing command, the processor unit 12 will be directed to deal the player a set of playing cards from a deck of simulated playing cards, and to show the set of playing cards face down on the display unit 13. The non-dealt simulated playing cards are shown face up on the display unit 13 such that the non-dealt simulated playing cards surround the set of playing cards dealt to the player. In this embodiment, the deck of simulated playing cards consists of thirty cards, including four suits of 8, 9, 10, J, Q, K, A cards and two wild cards. As shown in FIG. 4, four cards are dealt to the player and are surrounded by the remaining twenty-six simulated playing cards. The flow proceeds to the next step (Step (c)).

Step (c): In this step, the processor unit 12 is directed to allow the player to place a first bet for at least one of the playing cards that were dealt and to place a second bet for the set of the playing cards that were dealt via the user input unit 11. In the example of FIG. 4, a first bet of ten points was placed for each of the playing cards that were dealt, and a second bet of ten points was placed for the set of the playing cards that were dealt. The flow proceeds to the next step (Step (d)) after the player has placed his desired bets.

Step (d): In this step, the processor unit 12 is directed to show the playing cards that were dealt face up on the display unit 13. The flow proceeds immediately to the next step (Step (e)).

Step (e): In this step, the processor unit 12 is directed to offer the player an opportunity to replace at least one of the playing cards in the set that was dealt with a corresponding number of the non-dealt simulated playing cards to be chosen in random by the gaming apparatus 1. The flow then proceeds to the next step (Step (f)).

Step (f): Random selection of one of the non-dealt simulated playing cards is performed in this step. To this end, the processor unit 12 is directed such that each of the non-dealt simulated playing cards that surround the dealt playing cards is momentarily lighted on the display unit 13 in a continuing random sequence. The player is allowed to interrupt the random sequence via the user input unit 11 such that the non-dealt simulated playing card lighted when the random sequence is interrupted is identified as the randomly selected playing card. The flow then proceeds to the next step (Step (g)).

Step (g): The winnings of the player in the first and second card games are determined in this step. To determine the winnings of the player in the first card game, the processor unit 12 is directed to match each of the playing cards placed with the first bet with the randomly selected playing card. To determine the winnings of the player in the second card game, the processor unit 12 is directed to combine the randomly selected playing card with the set of the playing cards dealt to the player to obtain a card hand. A value for the card hand is then evaluated in accordance with a predetermined poker hand ranking. In the example of FIG. 4, since the K card was randomly selected, the randomly selected card matches two of the dealt playing cards, and the card hand of the player is a "Full House". The flow then proceeds to the next step (Step (h)).

Step (h): In this step, the processor unit 12 is directed to adjust a credit total for the player according to the winnings of the player in the first and second card games. After showing the game result on the display unit 13, the flow goes back to step (a).

Preferably, audio data is sent to the sound generating unit 14 to enhance excitement during play.

The two wild cards in the deck of simulated playing cards of this embodiment are an "optimize" card 21 and a "chance" card 22.

When the "optimize" card is randomly selected, the processor unit 12 will be directed to light three to seven of the non-dealt simulated playing cards. The lighted one of the simulated playing cards, which yields the largest winnings for the player, will then be selected automatically by the gaming apparatus 1. For example, when the dealt cards are AAKQ, and the three lighted candidate cards are AK10, the gaming apparatus 1 will select the lighted candidate card A when determining the winnings of the player.

When the "chance" card is randomly selected, the processor unit 12 will be directed to allow the player to change face values of three to eight of the non-dealt simulated playing cards to increase the player's chances of winning during a succeeding random card selection operation. For instance, when the dealt cards are 9JJJ, the player may be allowed to change face values of five lighted candidate cards to J.

It has thus been shown that the computer-implemented method and gaming apparatus of this invention enable players to play two different card games simultaneously in a single game round so as to satisfy their desire for variety without increasing the operating costs of business establishments.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A computer-implemented method for playing first and second card games simultaneously, comprising:

(a) providing a gaming apparatus that includes a user input unit and a display unit;

(b) dealing a player a set of playing cards from a deck of simulated playing cards, and showing the set of the playing cards face down on the display unit;

(c) allowing the player to place a first bet for at least one of the playing cards and to place a second bet for the set of the playing cards via the user input unit; and (d) playing the first and second card games simultaneously, including the steps of showing the set of the playing cards face up on the display unit, randomly selecting another one of the playing cards from the non-dealt simulated playing cards in the deck, determining winnings of the player in the first card game by matching each of the playing cards placed with the first bet with the randomly selected one of the playing cards, combining the randomly selected one of the playing cards with the set of the playing cards dealt to the player to obtain a card hand, determining winnings of the player in the second card game by evaluating a value for the card hand in accordance with a predetermined poker hand ranking, and adjusting a credit total for the player according to the winnings of the player in the first and second card game.

2. The computer-implemented method as claimed in claim 1, wherein the step of randomly selecting another one of the playing cards includes the sub-steps of:

d-1) showing the non-dealt simulated playing cards face up on the display unit such that the non-dealt simulated playing cards surround the set of playing cards dealt to the player;

d-2) momentarily lighting each of the non-dealt simulated playing cards in a continuing random sequence; and d-3) allowing the player to interrupt the random sequence via the user input unit such that one of the non-dealt simulated playing cards lighted when the random sequence is interrupted is identified as the randomly selected one of the playing cards.

3. The computer-implemented method as claimed in claim 2, wherein step (d) further includes the step of, prior to randomly selecting another one of the playing cards, offering the player an opportunity to replace at least one of the playing cards in the set that was dealt with a corresponding number of the non-dealt simulated playing cards to be randomly chosen by the gaming apparatus.

4. A computer program product for a gaming apparatus that includes a user input unit, a display unit and a processor unit coupled to the user input unit and the display unit, said computer program product adapting the gaming apparatus for playing first and second card games simultaneously, said computer program product comprising:

a computer readable storage medium comprising:

a first code that directs the processor unit to deal a player a set of playing cards from a deck of simulated playing cards, and to show the set of the playing cards face down on the display unit;

a second code that directs the processor unit to allow the player to place a first bet for at least one of the playing cards and to place a second bet for the set of the playing cards via the user input unit; and a third code that directs the processor unit to play the first and second card games simultaneously, including a code that directs the processor unit to show the set of the playing cards face up on the display unit, a code that directs the processor unit to randomly select another one of the playing cards from the non-dealt simulated playing cards in the deck, a code that directs the processor unit to determine winnings of the player in the first card game by matching each of the playing cards placed with the first bet with the randomly selected one of the playing cards, a code that directs the processor unit to combine the randomly selected one of the playing cards with the set of the playing cards dealt to the player to obtain a card hand, a code that directs the processor unit to determine winnings of the player in the second card game by evaluating a value for the card hand in accordance with a predetermined poker hand ranking, and a code that directs the processor unit to adjust a credit total for the player according to the winnings of the player in the first and second card games.

5. The computer program product as claimed in claim 4, wherein said code that directs the processor unit to randomly select another one of the playing cards includes:

a code that directs the processor unit to show the non-dealt simulated playing cards face up on the display unit such that the non-dealt simulated playing cards surround the set of playing cards dealt to the player;

a code that directs the processor unit such that each of the non-dealt simulated playing cards is momentarily lighted in a continuing random sequence; and a code that directs the processor unit to allow the player to interrupt the random sequence via the user input unit such that one of the non-dealt simulated playing cards lighted when the random sequence is interrupted is identified as the randomly selected one of the playing cards.

6. The computer program product as claimed in claim 5, wherein said third code further includes a code that directs the processor unit to offer the player an opportunity to replace at least one of the playing cards in the set that was dealt with a corresponding number of the non-dealt simulated playing cards to be randomly chosen by the gaming apparatus prior to random selection of said another one of the playing cards.

7. A gaming apparatus for playing first and second card games simultaneously, comprising:

a user input unit;

a display unit;

means for dealing a player a set of playing cards from a deck of simulated playing cards, and for showing the set of the playing cards face down on said display unit;

means for allowing the player to place a first bet for at least one of the playing cards and to place a second bet for the set of the playing cards via said user input unit; and means for playing the first and second card games simultaneously, including means for showing the set of the playing cards face up on said display unit, means for randomly selecting another one of the playing cards from the non-dealt simulated playing cards in the deck, means for determining winnings of the player in the first card game by matching each of the playing cards placed with the first bet with the randomly selected one of the playing cards, means for combining the randomly selected one of the playing cards with the set of the playing cards dealt to the player to obtain a card hand, means for determining winnings of the player in the second card game by evaluating a value for the card hand in accordance with a predetermined poker hand ranking, and means for adjusting a credit total for the player according to the winnings of the player in the first and second card games.

8. The gaming apparatus as claimed in claim 7, wherein said means for randomly selecting another one of the playing cards includes:

means for showing the non-dealt simulated playing cards face up on said display unit such that the non-dealt simulated playing cards surround the set of playing cards dealt to the player;

means for momentarily lighting each of the non-dealt simulated playing cards in a continuing random sequence; and means for allowing the player to interrupt the random sequence via said user input unit such that one of the non-dealt simulated playing cards lighted when the random sequence is interrupted is identified as the randomly selected one of the playing cards.

9. The gaming apparatus as claimed in claim 8, wherein said means for playing the first and second card games further includes means for offering the player an opportunity to replace at least one of the playing cards in the set that was dealt with a corresponding number of the non-dealt simulated playing cards to be randomly chosen by the gaming apparatus prior to random selection of said another one of the playing cards.

10. A gaming apparatus comprising a user input unit, a display unit, a processor unit coupled to said user input unit and said display unit, and a computer program product for adapting said gaming apparatus for playing first and second card games simultaneously, said computer program product comprising a computer readable storage medium that includes:

a first code that directs said processor unit to deal a player a set of playing cards from a deck of simulated playing cards, and to show the set of the playing cards face down on said display unit;

a second code that directs said processor unit to allow the player to place a first bet for at least one of the playing cards and to place a second bet for the set of the playing cards via said user input unit; and a third code that directs said processor unit to play the first and second card games simultaneously, including a code that directs said processor unit to show the set of the playing cards face up on said display unit, a code that directs said processor unit to randomly select another one of the playing cards from the non-dealt simulated playing cards in the deck, a code that directs said processor unit to determine winnings of the player in the first card game by matching each of the playing cards placed with the first bet with the randomly selected one of the playing cards, a code that directs said processor unit to combine the randomly selected one of the playing cards with the set of the playing cards dealt to the player to obtain a card hand, a code that directs said processor unit to determine winnings of the player in the second card game by evaluating a value for the card hand in accordance with a predetermined poker hand ranking, and a code that directs said processor unit to adjust a credit total for the player according to the winnings of the player in the first and second card games.

11. The gaming apparatus as claimed in claim 10, wherein said code that directs said processor unit to randomly select another one of the playing cards includes:

a code that directs said processor unit to show the non-dealt simulated playing cards face up on said display unit such that the non-dealt simulated playing cards surround the set of playing cards dealt to the player;

a code that directs said processor unit such that each of the non-dealt simulated playing cards is momentarily lighted in a continuing random sequence; and a code that directs said processor unit to allow the player to interrupt the random sequence via said user input unit such that one of the non-dealt simulated playing cards lighted when the random sequence is interrupted is identified as the randomly selected one of the playing cards.

12. The gaming apparatus as claimed in claim 11, wherein said third code further includes a code that directs said processor unit to offer the player an opportunity to replace at least one of the playing cards in the set that was dealt with a corresponding number of the non-dealt simulated playing cards to be randomly chosen by said gaming apparatus prior to random selection of said another one of the playing cards.

* * * * *